US011313208B2

(12) United States Patent
Hoelscher et al.

(10) Patent No.: US 11,313,208 B2
(45) Date of Patent: Apr. 26, 2022

(54) DETONATION CORD ALIGNMENT AND RETENTION

(71) Applicant: Halliburton Energy Services, Inc., Houston, TX (US)

(72) Inventors: Christopher C. Hoelscher, Arlington, TX (US); Joseph Todd MacGillivray, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/931,037

(22) Filed: May 13, 2020

(65) Prior Publication Data

US 2021/0355798 A1 Nov. 18, 2021

(51) Int. Cl.
*E21B 43/1185* (2006.01)
*E21B 43/117* (2006.01)

(52) U.S. Cl.
CPC ..... *E21B 43/1185* (2013.01); *E21B 43/117* (2013.01)

(58) Field of Classification Search
CPC ..... E21B 43/1185; E21B 43/117
USPC ..... 89/1.15
See application file for complete search history.

(56) References Cited

U.S. PATENT DOCUMENTS

| | | | | |
|---|---|---|---|---|
| 3,033,600 | A * | 5/1962 | Drysdale | B21F 15/06 403/274 |
| 5,201,598 | A * | 4/1993 | Tehan | E04H 15/60 403/372 |
| 6,397,752 | B1 | 6/2002 | Yang et al. | |
| 8,985,023 | B2 | 3/2015 | Mason | |
| 9,598,941 | B1 | 3/2017 | Upchurch et al. | |
| 2013/0291711 | A1 | 11/2013 | Mason | |
| 2017/0009532 | A1 | 1/2017 | Wight et al. | |
| 2018/0112500 | A1 | 4/2018 | Collins et al. | |
| 2019/0292887 | A1* | 9/2019 | Austin, II | E21B 43/117 |

* cited by examiner

*Primary Examiner* — Jonathan C Weber
(74) *Attorney, Agent, or Firm* — John Wustenberg; Parker Justiss, P.C.

(57) ABSTRACT

Provided is a detonation cord alignment apparatus. The detonation cord alignment apparatus, in accordance with one example, includes a detonation cord alignment housing having a detonation cord opening extending there through, and one or more protrusions extending inward from the detonation cord opening for linearly securing a detonation cord therein.

16 Claims, 5 Drawing Sheets

DETONATION CORD ALIGNMENT AND RETENTION

BACKGROUND

After drilling various sections of a subterranean wellbore that traverse a formation, individual lengths of relatively large diameter metal tubulars are typically secured together to form a casing string that is positioned (e.g., cemented) within the wellbore. This casing string increases the integrity of the wellbore and provides a path for producing fluids to travel from the producing intervals to the surface. To produce fluids into the casing string, openings or perforations are made through the casing string, the cement and a short distance into the formation.

These perforations are created by detonating a series of charges that are disposed within the casing string adjacent to the formation of interest. For example, one or more perforating guns may be loaded with charges that are connected with a detonator via a detonation cord. The perforating guns are then connected within a tool string that is lowered into the wellbore at the end of a tubing string, wireline, slick line, coil tubing or another conveyance. Once the perforating guns are properly positioned in the wellbore (e.g., such that the charges are adjacent to the formation of interest), the charges are detonated, thereby creating the desired openings or perforations.

BRIEF DESCRIPTION

Reference is now made to the following descriptions taken in conjunction with the accompanying drawings, in which.

DETAILED DESCRIPTION

Figure 1:
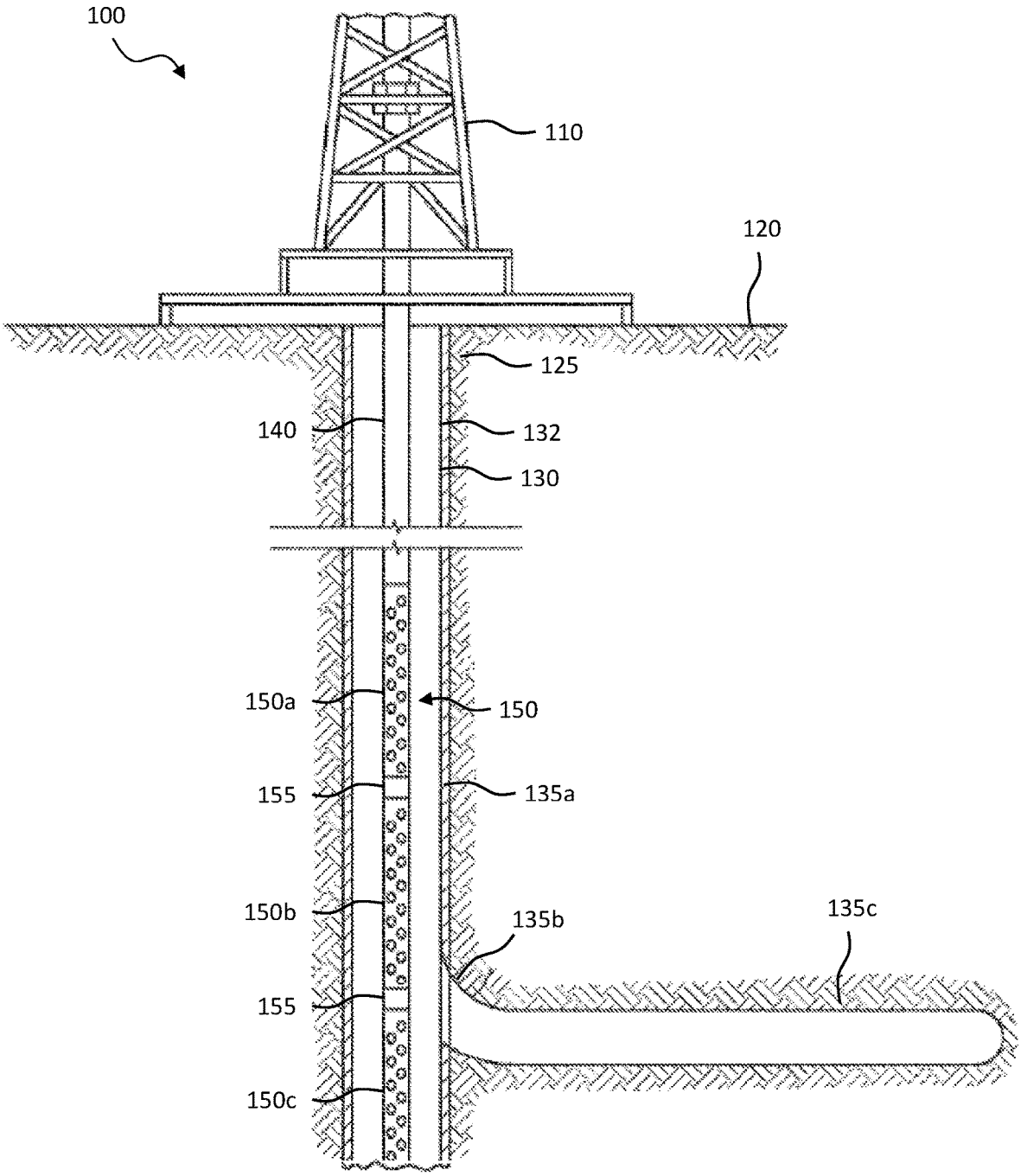
FIG. 1 illustrates a well system designed, manufactured, and operated according to one or more examples of the disclosure.

Specific examples are described in detail and are shown in the drawings, with the understanding that the present disclosure is to be considered an exemplification of the principles of the disclosure, and is not intended to limit the disclosure to that illustrated and described herein. It is to be fully recognized that the different teachings of the examples discussed herein may be employed separately or in any suitable combination to produce desired results.

A detonation alignment apparatus and method are disclosed for beneficially securing a detonation cord used in a perforating gun assembly. In various example configurations detailed below, the apparatus may allow the detonation cord to be received within the opening of a housing, and to secure the detonation cord within the housing by resisting movement of the detonation cord relative to the opening once received. One or more example configurations of such a housing may allow the detonation cord to be slidingly inserted into the opening of the housing, while resisting movement of the cord in an opposite direction relative to the housing. More particularly, disclosed configurations of the housing may include one or more inwardly directed protrusions oriented and relatively positioned to automatically increase resistance in response to urging the detonation cord in an opposite direction thereby resisting removal. In one or more configurations, the detonation cord may be inserted into the housing in an insertion direction, and urging the detonation cord in the opposite direction automatically increases resistance thereby resisting removal. Preferably, the resistance is increased sufficiently to prevent removal of the detonation cord from the housing under foreseeable handling conditions of the perforating gun system.

The use of a detonation cord alignment apparatus as described herein, alone or in combination with other alignment features, may beneficially allow for a consistent and reliable coupling of a detonation cord with other explosive features, thereby improving the reliability of the chain of explosives used in the detonation process. For instance, the use of the detonation cord alignment apparatus as described herein may allow for a consistent and reliable coupling of the detonation cord and the detonator, for example by linearly securing the detonation cord relative to the detonator. Additionally, the use of the detonation cord alignment apparatus as described herein may allow for a consistent and reliable coupling of the detonation cord with the plurality of shaped charges that the detonator cord is configured to ignite, for example by linearly securing the detonation cord relative to the plurality of shaped charges. This may help avoid an improper, incomplete, and/or unreliable coupling to avoid the failure of a shaped charge to detonate, and thus avoiding the failure of subsequent shaped charges in the chain to detonate as well. This may help avoid a need to withdraw the perforating gun assembly from the wellbore, which can be a costly process that takes several days while presenting the possibility of a misfire while being withdrawn from the wellbore. The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 illustrates a well system 100 designed, manufactured, and operated according to one or more examples of the disclosure. As depicted, the well system 100 includes a workover and/or drilling rig 110 that is positioned above the earth's surface 120 and extends over and around a wellbore 130 that penetrates a subterranean formation 125 for the purpose of recovering hydrocarbons. The subterranean formation 125 may be located below exposed earth, as shown, as well as areas below earth covered by water, such as ocean or fresh water.

The wellbore 130 may be drilled into the subterranean formation 125 using any suitable drilling technique. In the example illustrated in FIG. 1, the wellbore 130 extends substantially vertically away from the earth's surface 120 over a vertical wellbore portion 135*a*, deviates from vertical relative to the earth's surface 120 over a deviated wellbore portion 135*b*, and transitions to a horizontal wellbore portion 135*c*. In alternative operating environments, all or portions of a wellbore may be vertical, deviated at any suitable angle, horizontal, and/or curved. The wellbore 130 may be a new wellbore, an existing wellbore, a straight wellbore, an extended reach wellbore, a sidetracked wellbore, a multi-lateral wellbore, and other types of wellbores for drilling and completing one or more production zones. Further, the wellbore 130 may be used for both producing wells and injection wells.

A wellbore conveyance 140 may be lowered into the wellbore 130 for a variety of drilling, completion, workover, treatment, and/or production processes, amongst others, throughout the life of the wellbore 130. The example shown in FIG. 1 illustrates the wellbore conveyance 140 in the form of a completion assembly string disposed in the wellbore 130. It should be understood that the wellbore conveyance 140 is equally applicable to any type of wellbore conveyance being inserted into a wellbore 130, including as non-limiting examples drill pipe, casing, liners, jointed tubing, coiled tubing, wireline, slickline, etc. Further, the wellbore conveyance 140 may operate in any of the wellbore orientations (e.g., vertical, deviated, horizontal, and/or curved) and/or types described herein. In one or more examples, the wellbore 130 comprises wellbore casing 132, which may be cemented into place in the wellbore 130. In an example, the wellbore conveyance 140 may comprise a completion assembly string comprising one or more wellbore tools, which may take various forms. For example, a zonal isolation device may be used to isolate the various zones within the wellbore 130 and may include, but is not limited to, a plug, a valve (e.g., lubricator valve, tubing retrievable safety valve, fluid loss valves, etc.), and/or a packer (e.g., production packer, gravel pack packer, frac-pac packer, etc.).

Coupled to the wellbore conveyance 140, in the example illustrated in FIG. 1, is a perforating gun assembly 150 designed, manufactured and/or operated according to one or more examples of the disclosure. The perforating gun assembly 150 illustrated in FIG. 1 includes a first gun set 150*a*, a second gun set 150*b*, and a third gun set 150*c*, for example coupled to each other using one or more gun connector housings 155. In accordance with one or more embodiments of the disclosure, the perforating gun assembly 150, whether it be the first, second or third gun sets 150*a*, 150*b*, 150*c*, includes a detonation cord alignment apparatus as shown in subsequent figures discussed in further detail below. Misfires related to the detonation cord and the various different shaped charges in the first, second, and third gun sets 150*a*, 150*b*, 150*c* (e.g., wherein the detonation cord alignment apparatus is one of the gun connector housings 155), may be reduced if not eliminated.

Figure 2:
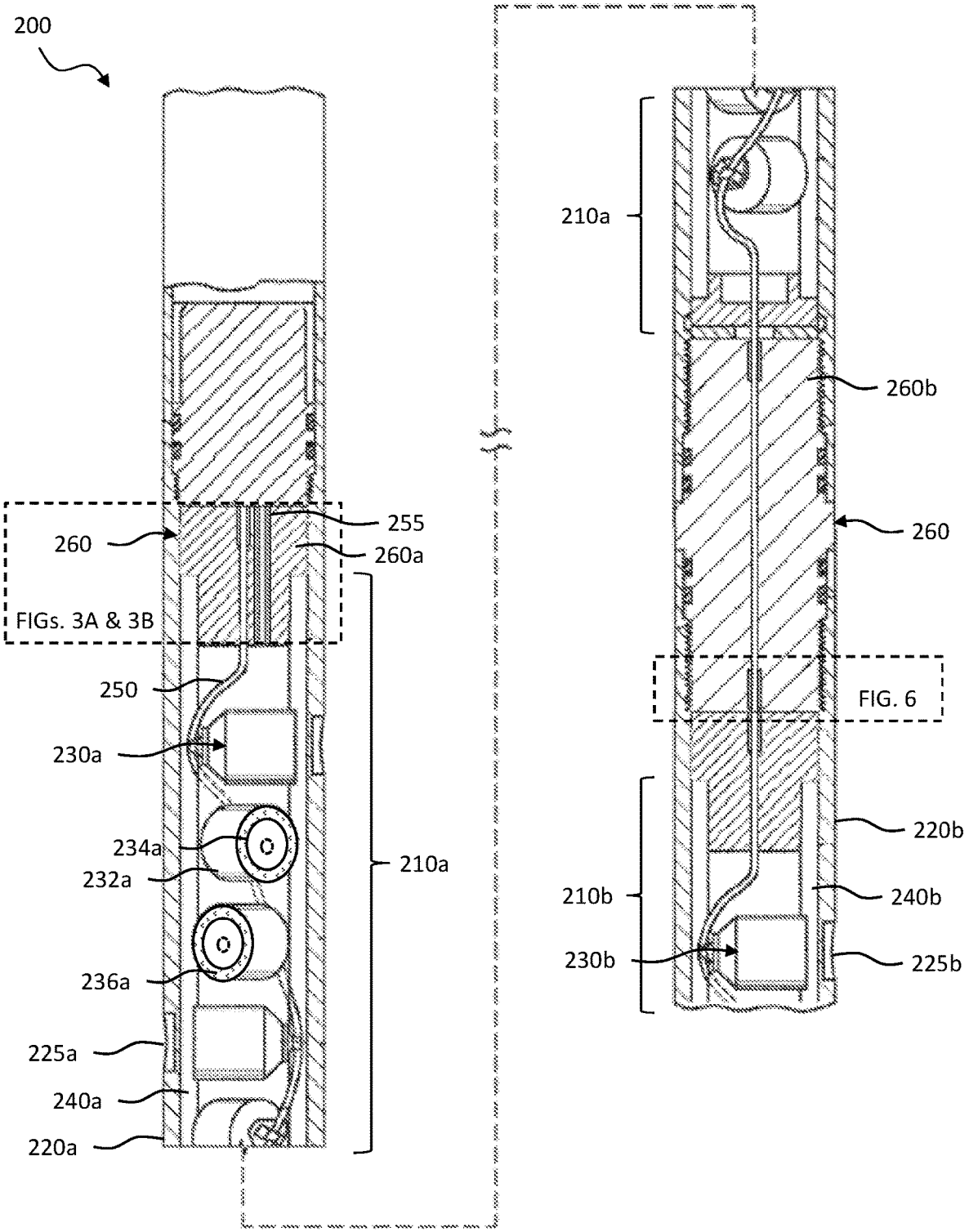
FIG. 2 is a cutaway view of a perforating gun assembly that may be designed, manufactured, and/or operated according to one or more aspects of the disclosure.

FIG. 2 is a cutaway view of a perforating gun assembly 200 that may be designed, manufactured, and/or operated according to one or more aspects of the disclosure. The perforating gun assembly 200 may form at least a portion of the perforating gun assembly 150 illustrated in FIG. 1. The perforating gun assembly 200 includes a first gun set 210*a* and a second gun set 210*b*. While two gun sets 210*a*, 210*b* are employed in the example of FIG. 2, other examples may exist wherein more or less than two gun sets 210*a*, 210*b* are employed.

The first gun set 210*a* includes a first carrier gun body 220*a*, which in one example may comprise a cylindrical sleeve, which may further have a plurality of recesses 225*a*. Radially aligned with each of the recesses 225*a* is a respective one of a first plurality of shaped charges 230*a*, only six of which are visible within the first gun set 210*a* of FIG. 2. While six shaped charges 230*a* are employed in the example of FIG. 2, other examples may exist wherein more or less than six shaped charges 230*a* are employed. Each of the first plurality of shaped charges 230*a* may include a housing 232*a*, for example including a housing exterior and a housing interior. Each of the first plurality of shaped charges 230*a* may further include a liner 234*a* positioned within the case interior of the housing 232*a*. Furthermore, explosive material 236*a* is disposed between the case interior of the housing 232*a* and the liner 234*a* in the example of FIG. 2.

The first plurality of shaped charges 230*a*, in the example shown, are retained within the first carrier gun body 220*a* by a charge tube 240*a*. In certain examples, the charge tube 240*a* supports a discharge end of the first plurality of shaped charges 230*a*, wherein an additional inner charge tube (not shown) supports an initiation end of the first plurality of shaped charges 230*a*.

In the example of FIG. 2, each of the first plurality of shaped charges 230*a* (e.g., when assembled) are longitudinally and radially aligned with one of the recesses 225*a* in the first carrier gun body 220*a*. In the illustrated example, the first plurality of shaped charges 230*a* are arranged in a spiral pattern such that each shaped charge 230*a* is disposed on its own level or height and is to be individually detonated so that only one shaped charge 230*a* is fired at a time. It should be understood, however, that alternate arrangements for the first plurality of shaped charges 230*a* may be used, including cluster type designs wherein more than one shaped charge 230*a* is at the same level and is detonated at the same time.

The second gun set 210*b* may include many of the same features as the first gun set 210*a*. For example, the second gun set 210*b* includes a second carrier gun body 220*b*, as well as a second plurality of shaped charges 230*b* retained within a second charge tube 240*b*. Each of the second plurality of shaped charges 230*b* may comprise similar components as each of the first plurality of shaped charges 230*a*.

The perforating gun assembly 200 further includes a detonation cord 250, which is used to detonate ones of the first and/or second plurality of shaped charges 230*a*, 230*b*. In the illustrated example, the initiation ends of the first and second plurality of shaped charges 230*a*, 230*b* extend across the central longitudinal axis of the perforating gun assembly 200, allowing the detonation cord 250 to connect to the explosive material, for example through an aperture defined at an apex of the housings 232*a*. In the embodiment of FIG. 2, only a single detonation cord 250 is employed to connect the first and second plurality of shaped charges 230*a*, 230*b*. Notwithstanding, other embodiments may exist wherein multiple detonation cords 250, in combination with one or more detonation boosters, may be employed in the perforating gun assembly 200.

The perforating gun assembly 200, in accordance with one or more embodiments of the disclosure, includes one or more detonation cord alignment apparatuses 260. The one or more detonation cord alignment apparatuses 260 may vary in purpose and structure and remain within the scope of the disclosure. For example, in the embodiment of FIG. 2, a detonator end alignment housing 260*a* is employed as one of the detonation cord alignment apparatuses 260. The detonator end alignment housing 260*a* could be employed to align an uphole or a downhole end of the detonation cord 250 with a detonator 255, as is necessary to ignite a detonation train in the detonation cord 250. In this example, the detonator end alignment housing 260*a* is supported within the first carrier gun body 220*a*, for example by the first charge tube 240*a*.

In contrast, a gun connector housing 260*b* may be employed as another of the detonation cord alignment apparatuses 260. The gun connector housing 260*b* could therefore employ one or more connections (e.g., threaded connections) to connect the first and second carrier gun bodies 220*a*, 220*b*, and thus the first gun set 210*a* and second gun set 210*b* together. In certain embodiments, both the detonator end alignment housing 260*a* and the gun connector housing 260*b* are employed as detonation cord alignment apparatuses 260.

Notwithstanding the foregoing, in one or more embodiments, one of the one or more detonation cord alignment apparatuses 260 includes a detonation cord alignment housing having a detonation cord opening extending there through. Further to these embodiments, one or more protrusions may extend inwardly from the detonation cord opening. The one or more protrusions do not necessarily extend directly from the detonation cord opening, but may extend indirectly from the detonation cord opening, for example by way of a detonation cord retention insert located within the detonation cord opening. The one or more protrusions, in at least one embodiment, linearly fix the detonation cord 250 within the detonation cord opening. In the case of the detonator end alignment housing 260*a*, the one or more protrusions linearly fix the detonation cord 250 within the detonation cord opening of the detonator end alignment housing 260*a*, and thus keep the detonation cord 250 aligned with the detonator 255. In the case of the gun connector housing 260*b*, the one or more protrusions linearly fix the detonation cord 250 within the detonation cord opening of the gun connector housing 260*b*, and thus keep the detonation cord 250 aligned with the first or second plurality of shaped charges 230*a*, 230*b*.

Figure 3A:
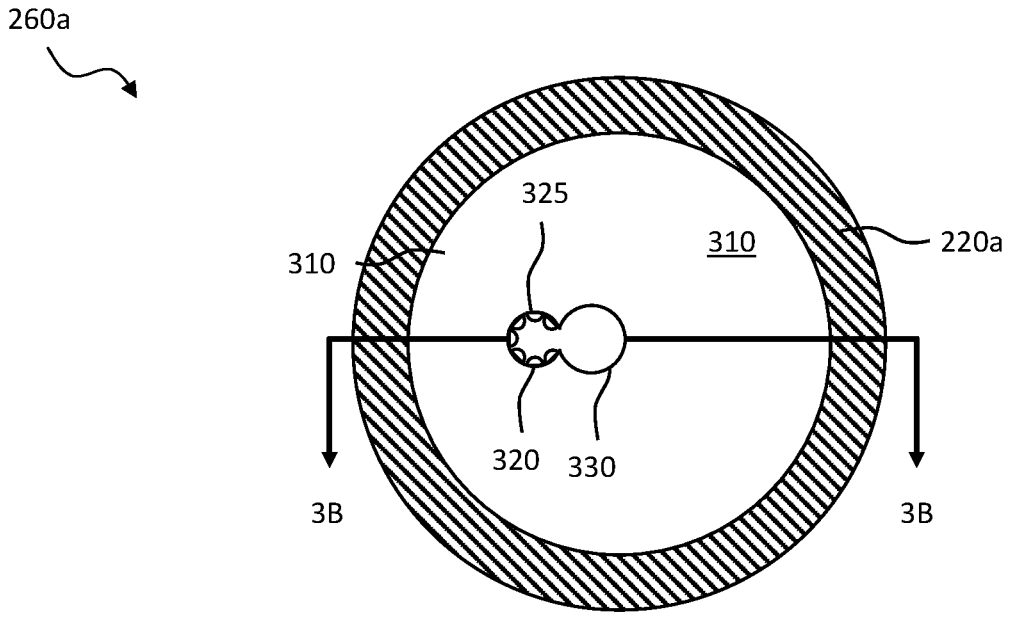
FIGS. 3A and 3B are enlarged views of the detonator end alignment housing of FIG. 2, further detailing various specific example features used to orient and secure the detonation cord.
Figure 3B:
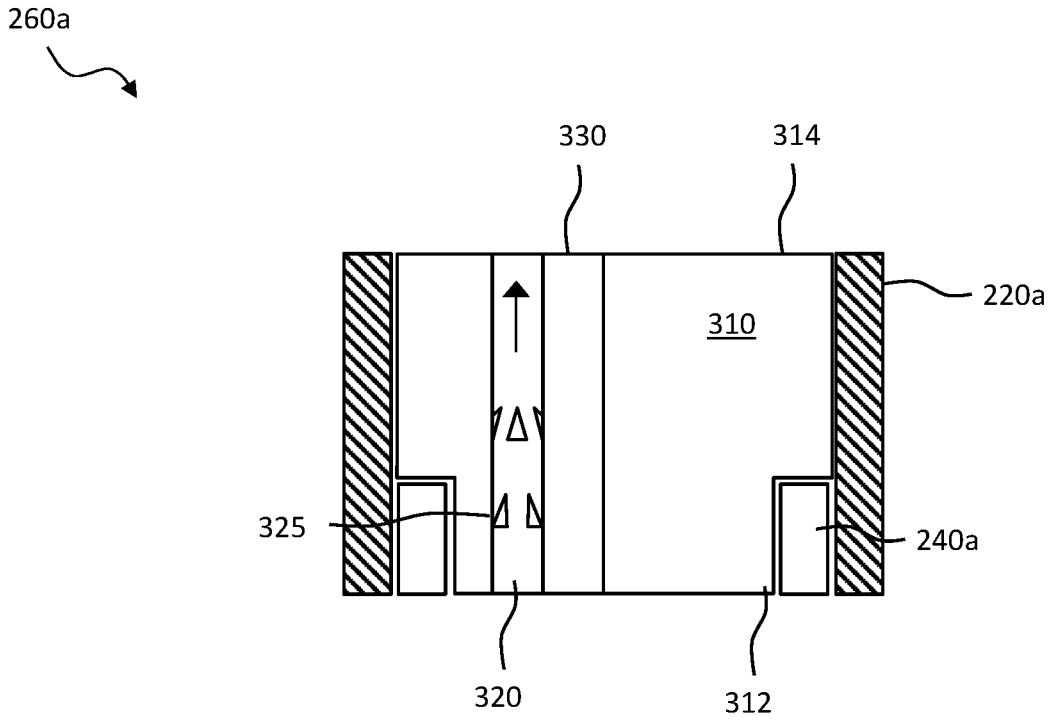

FIGS. 3A and 3B are enlarged views of the detonator end alignment housing 260*a* of FIG. 2, further detailing various specific example features used to orient and secure the detonation cord 250. FIG. 3A illustrates a top down view of the detonator end alignment housing 260*a*, whereas FIG. 3B illustrates a cross-sectional view of the detonator end alignment housing 260*a* taken through the line 3B-3B in FIG. 3A. In accordance with the disclosure, the detonator end alignment housing 260*a* includes a detonation cord alignment housing 310 including a first end 312 and a second opposing end 314. The detonation cord alignment housing 310, in the illustrated example, further includes a detonation cord opening 320 and a detonator opening 330 therein. In accordance with one example, the detonation cord opening 320 extends entirely through the detonation cord alignment housing 310 from the first end 312 to the second opposing end 314. In accordance with another embodiment, the detonator opening 330 also extends entirely through the detonation cord alignment housing 310 from the first end 312 to the second opposing end 314. Further to the embodiment of FIGS. 3A and 3B, the detonator end alignment housing 260*a* includes one or more protrusions 325 extending inward (e.g., directly or indirectly) from the detonation cord opening 320. The one or more protrusions 325 are designed to linearly secure a detonation cord (e.g., the detonation cord 250) therein.

The one or more protrusions 325 may take on many different designs and/or shapes and remain within the scope of the disclosure. For example, the one or more protrusions 325 may be one more angled barbs (e.g., as shown in FIGS. 3A and 3B) extending inward from the detonation cord opening 320. These angled barbs may allow the detonation cord 250 to slide linearly in a first direction (e.g., as represented by the arrow), such as cases where assembly calls for the detonation cord 250 to be positioned within the opening 320 by sliding in an insertion direction (i.e., the insertion direction in that example). The angled barbs then help secure the detonation cord 250 against removal in a second direction opposite the first direction. In particular, the barbs may frictionally engage the detonation cord 250, which can be overcome by sliding in the first direction. By virtue of the barb geometry, urging the detonation cord 250 in a direction opposite the insertion direction (e.g. by inadvertently yanking on the detonation cord) urges the barbs radially inwardly into more forcible engagement with the detonation cord 250, thereby increasing the friction and resisting removal. The frictional resistance may increase in proportion to the forces urging the detonation cord 250 such that the resistance to removal matches or exceeds the forces urging the cord's removal.

In the illustrated embodiment, the angled barbs may allow the detonation cord 250 to slide in the first direction toward the second end 314, but prevent the detonation cord 250 from sliding in the second opposite direction toward the first opposing end 312. Accordingly, when the detonator 255 is located within the detonator opening 330, the detonation cord 250 may be fixed in one direction relative to the detonator 255, but allowed to slide in the second opposing direction relative to the detonator 255. In the illustrated example, the one or more protrusions are linearly and radially staggered. In other embodiments, the one or more protrusions 325 are not angled, and thus linearly secure (e.g., to some degree) the detonation cord 250 in the first and second directions. For example, the one or more protrusions could be one or more nubs, which press upon the detonation cord 250 and make it difficult to slide within the detonation cord opening 320.

The one or more protrusions 325, especially when they are angled barbs, may be configured to penetrate an outer surface of the detonation cord 250 upon sliding the detonation cord 250 into the detonation cord opening 320 and then beginning to move the detonation cord 250 in the opposite direction out of the detonation cord opening 320. The detonation cord 250 generally includes an inner layer comprising an explosive, an optional layer of fiber, then an outer layer of insulation. The one or more protrusions 325 may be configured to penetrate one or more of these layers, thereby linearly securing the detonation cord 250 from movement in the one direction within the detonation cord opening 320. In one example, the one or more protrusions 325 may penetrate the insulation layer on the outside of the detonation cord 250. In another example, the one or more protrusions 325 may penetrate through the insulation and the fiber layer. In an alternate example, the one or more protrusions 325 may penetrate through the insulation and the fiber layer and into the explosive layer. The one or more protrusions 325 can be stamped, cold-formed, machined, created by a hand tool or other manual mechanical deformation injection molded, investment cast, or by any other known way of forming one or more protrusions within an opening.

The detonator opening 330, in the embodiment of FIGS. 3A and 3B, is at least partially offset from and aligned with the detonation cord opening 320. In another embodiment, as shown, the detonation cord opening 320 and the detonator opening 330 at least partially overlap each other, such that no spacing exists between the two, as shown in FIG. 3A. The partial overlap, in one example, allows an easier transfer of the detonation train from the detonator 255 to the detonation cord 250 upon the detonation of the detonator 255.

Figure 4:
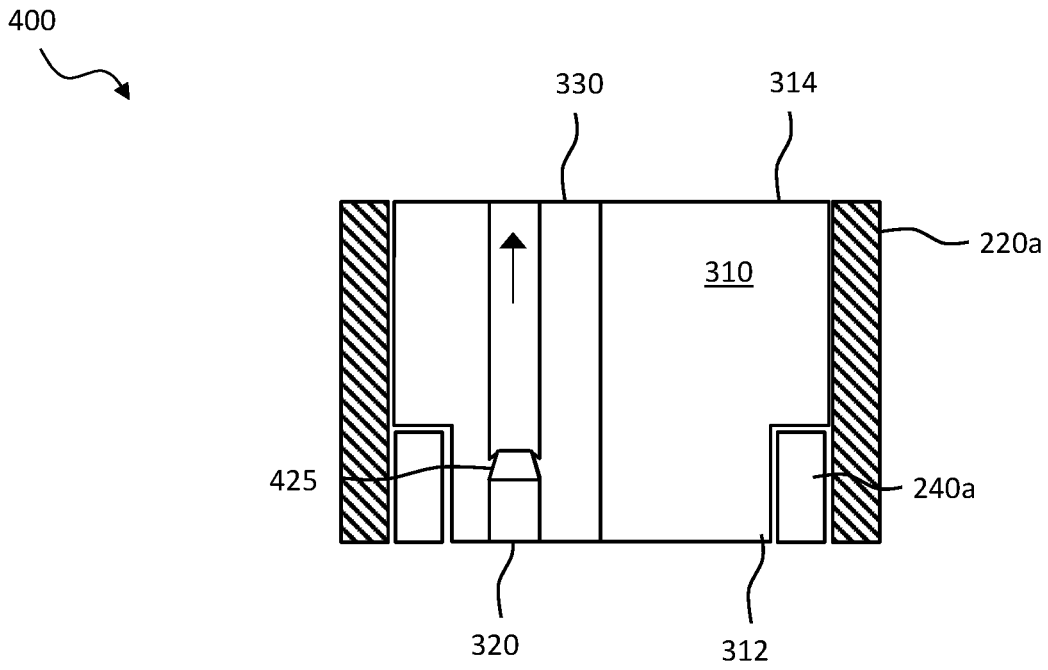
FIG. 4 illustrates an alternative embodiment of a detonator end alignment housing designed and manufactured according to one example of the disclosure.

FIG. 4 illustrates an alternative embodiment of a detonator end alignment housing 400 designed and manufactured according to one example of the disclosure. The detonator end alignment housing 400 is similar in many respects to the detonator end alignment housing 260*a* of FIGS. 3A and 3B. Accordingly, like reference numbers have been used to indicate similar, if not identical, features. The detonator end alignment housing 400 differs, for the most part, from the detonator end alignment housing 260*a*, in that the detonator end alignment housing 400 includes only a single protrusion 425 extending inward from the detonation cord opening 320. The single protrusion 425, in one example, is a semi-revolved protrusion that linearly fixes the detonation cord 250 within the detonation cord opening 320. Furthermore, the single protrusion 425 is a single angled barb for allowing the detonation cord to slide in a first direction and linearly securing the detonation cord 250 in a second, opposite direction, as shown in FIG. 4.

Figure 5:
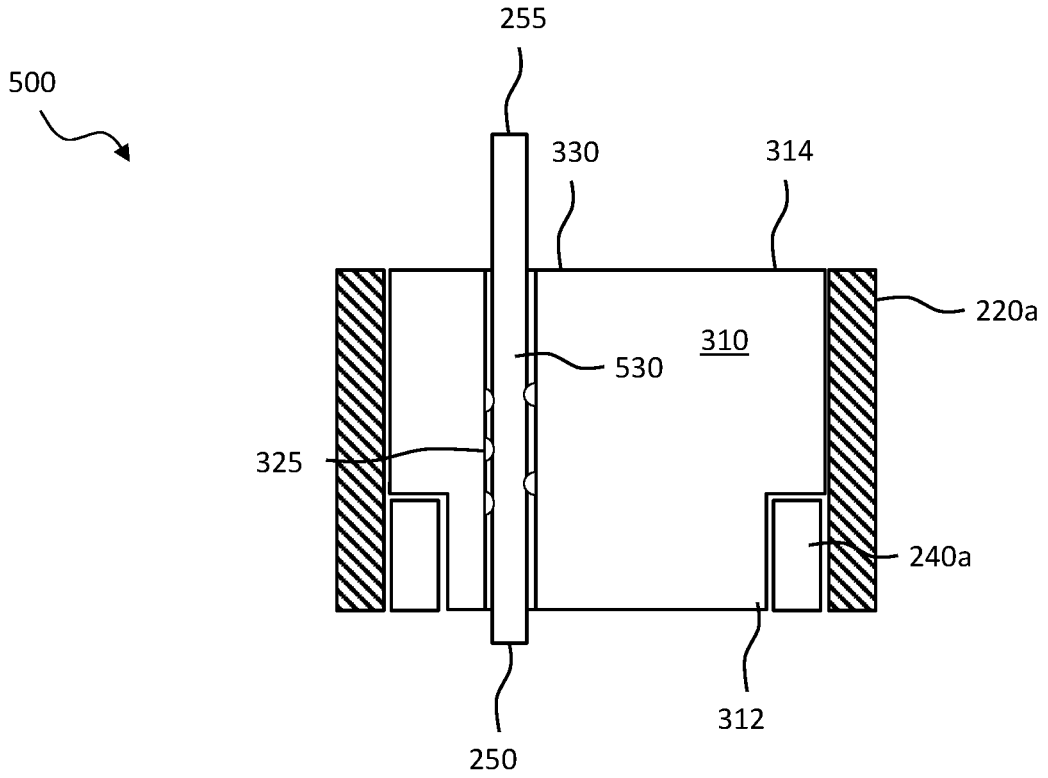
FIG. 5 illustrates an alternative embodiment of a detonator end alignment housing designed and manufactured according to another example of the disclosure.

FIG. 5 illustrates an alternative embodiment of a detonator end alignment housing 500 designed and manufactured according to another example of the disclosure. The detonator end alignment housing 500 is similar in many respects to the detonator end alignment housing 260*a* of FIGS. 3A and 3B. Accordingly, like reference numbers have been used to indicate similar, if not identical, features. The detonator end alignment housing 500 differs, for the most part, from the detonator end alignment housing 260*a*, in that the detonator end alignment housing 500 employs one or more nubs 525 as the one or more protrusions. The one or more numbs 525, in contrast to the one or more angled barbs, fixes (e.g., to some extent) the detonation cord 250 within the detonation cord opening 320 in both directions. The detonator end alignment housing 500 also differs from the detonator end alignment housing 260*a*, in that a centerline of the detonator opening 530 is aligned with a centerline of the detonation cord opening 320. Accordingly, detonator end alignment housing 500 employs an end to end connection between the detonator 255 and the detonation cord 250, which is in contrast to that which is illustrated in FIGS. 3B and 4.

Figure 6:
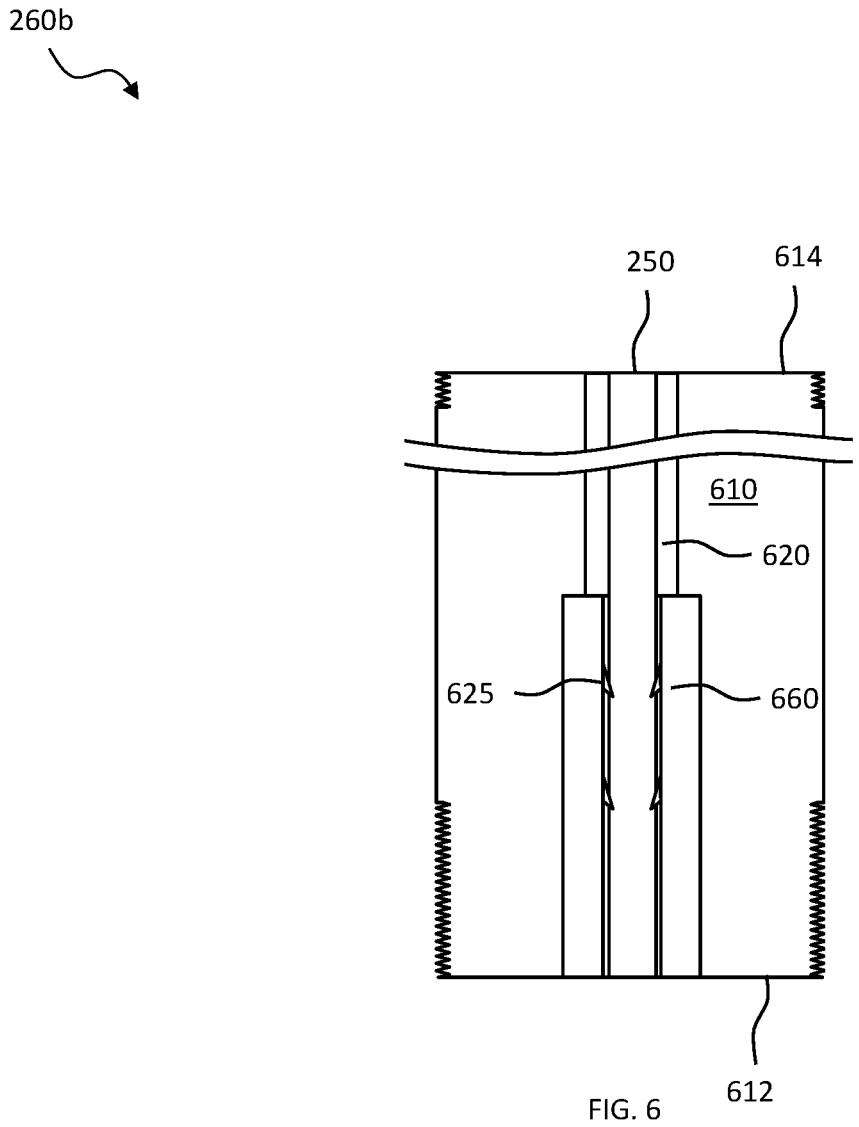
FIG. 6 illustrates an enlarged cross-sectional view of the gun connector housing depicted in FIG. 2.

FIG. 6 illustrates an enlarged cross-sectional view of the gun connector housing 260*b* depicted in FIG. 2. In accordance with one embodiment of the disclosure, the gun connector housing 260*b* includes a detonation cord alignment housing 610 including a first end 612 and a second opposing end 614. The detonation cord alignment housing 610, in the illustrated example, includes a detonation cord opening 620 therein. In accordance with one embodiment, the detonation cord opening 620 extends entirely through the detonation cord alignment housing 610 from the first end 612 to the second opposing end 614. Further to the embodiment of FIG. 6, the gun connector housing 260*b* includes one or more protrusions 625 extending inward from the detonation cord opening 620. The one or more protrusions 625 are designed to linearly secure a detonation cord (e.g., the detonation cord 250) therein. Thus, while the gun connector housing 260*b* may connect a pair of gun sets together, it may also linearly secure the detonation cord 250 relative to the shaped charges within the pair of gun sets.

Further to the embodiment of FIG. 6, the gun connector housing 260*b* additionally includes a detonation cord retention insert 660 located within the detonation cord opening 620. In accordance with this embodiment, the detonation cord retention insert 660 comprises, without limitation, metal or plastic and includes the one or more protrusions 625 for linearly securing the detonation cord. Accordingly, wherein in the embodiment of FIGS. 3A and 3B the one or more protrusions 325 extend inwardly and directly from the detonation cord opening 320, in the embodiment of FIG. 6 the one or more protrusions 625 also extend inward from the detonation cord opening 620, but in this example directly from the detonation cord retention insert 660. According to this embodiment, different detonation cord retention inserts 660, with different diameters, and/or placement of the protrusions 625, may be interchanged within the detonation cord opening 620. While the detonation cord retention insert 660 has been employed within the gun connector housing 260*b*, other embodiments may exist wherein the detonation cord retention insert 660 is employed with the detonator end alignment housing 260*a*.

In the illustrated embodiment of FIG. 6, the detonation cord 250 extends entirely from the first end 612 to the second opposing end 614. Accordingly, no gap exists between either of the first end 612 or second opposing end 614 and the detonation cord 250. In certain embodiments, a single detonation cord 250 is employed for the entire perforating gun assembly (e.g., 200), and thus the single detonation cord 250 would extend from the first gun set, entirely through the gun connector housing 260*b* and to the second gun set.

Aspects disclosed herein include:

A. A detonation cord alignment apparatus, the detonation cord alignment apparatus including: 1) a detonation cord alignment housing having a detonation cord opening extending there through for receiving a detonation cord; and 2) one or more protrusions extending inward from the detonation cord opening for linearly securing the detonation cord therein.

B. A perforating gun assembly for use in a wellbore, the perforating gun assembly including: 1) a carrier gun body; 2) a detonation cord alignment apparatus supported by the carrier gun body, the detonation cord alignment apparatus including a detonation cord alignment housing having a detonation cord opening extending there through, and one or more protrusions extending inward from the detonation cord opening; 3) a plurality of shaped charges supported within the carrier gun body; and 4) a detonation cord extending through the detonation cord alignment housing to the plurality of shaped charges, the one or more protrusions linearly securing the detonation cord in the detonation cord opening.

C. A well system, the well system including: 1) a wellbore; and 2) a perforating gun assembly positioned within the wellbore, the perforating gun assembly held in place by a conveyance and including, a) a carrier gun body; b) a detonation cord alignment apparatus supported by the carrier gun body, the detonation cord alignment apparatus including a detonation cord alignment housing having a detonation cord opening extending there through, and one or more protrusions extending inward from the detonation cord opening; c) a plurality of shaped charges supported within the carrier gun body; and d) a detonation cord extending through the detonation cord alignment housing to the plurality of shaped charges, the one or more protrusions linearly securing the detonation cord in the detonation cord opening.

Aspects A, B, and C may have one or more of the following additional elements in combination: Element 1: wherein the one or more protrusions are one or more angled barbs extending inward from the detonation cord opening for allowing the detonation cord to slide in a first direction and increase resistance to sliding of the detonation cord in a second opposite direction. Element 2: wherein the one or more protrusions are linearly and radially staggered. Element 3: wherein the one or more protrusions are only a single protrusion. Element 4: further including a detonation cord retention insert located within the detonation cord opening, the detonation cord retention insert including the one or more protrusions for linearly securing the detonation cord. Element 5: wherein the detonation cord retention insert comprises metal or plastic. Element 6: wherein the detonation cord alignment housing is a detonator end alignment housing. Element 7: wherein the detonator end alignment housing includes a detonator opening therein. Element 8: wherein the detonator opening is at least partially offset from and aligned with the detonation cord opening. Element 9: wherein the detonation cord opening and detonator opening at least partially overlap each other. Element 10: wherein the detonation cord alignment housing is a gun connector housing for connecting multiple carrier gun bodies together. Element 11: wherein the one or more protrusions are one or more angled barbs extending inward from the detonation cord opening for allowing the detonation cord to slide in a first direction and increase resistance to sliding of the detonation cord in a second opposite direction. Element 12: further including a detonation cord retention insert located within the detonation cord opening, the detonation cord retention insert including the one or more protrusions for linearly securing the detonation cord. Element 13: wherein the detonation cord alignment housing is a detonator end alignment housing supported within the carrier gun body, the detonator end alignment housing further including a detonator opening therein, and a detonator located within the detonator opening. Element 14: wherein the detonator opening is at least partially offset from and aligned with the detonation cord opening. Element 15: wherein the detonation cord alignment housing is a gun connector housing connecting the carrier gun body to a second carrier gun body having a second plurality of shaped charges supported therein, and further wherein the detonation cord extends from the plurality of shaped charges through the gun connector housing to the second plurality of shaped charges, the one or more protrusions linearly securing the detonation cord in the detonation cord opening in the gun connector housing. Element 16: wherein the detonation cord alignment housing is a detonator end alignment housing supported within the carrier gun housing, the detonator end alignment housing further including a detonator opening therein, and a detonator located within the detonator opening. Element 17: wherein the detonation cord alignment housing is a gun connector housing connecting the carrier gun body to a second carrier gun body having a second plurality of shaped charges supported therein, and further wherein the detonation cord extends from the plurality of shaped charges through the gun connector housing to the second plurality of shaped charges, the one or more protrusions linearly securing the detonation cord in the detonation cord opening in the gun connector housing.

What is claimed is:

1. A detonation cord alignment apparatus, comprising:

a gun connector housing having a detonation cord opening extending entirely there through for receiving a detonation cord, the gun connector housing having a first threaded connection at a first end thereof and a second threaded connection at a second end thereof, the first threaded connection configured to engage with a first carrier gun body and the second threaded connection configured to engage with a second carrier gun body; and one or more protrusions extending inward from the detonation cord opening for linearly securing the detonation cord in the gun connector housing.

2. The detonation cord alignment apparatus as recited in claim 1, wherein the one or more protrusions are one or more angled barbs extending inward from the detonation cord opening for allowing the detonation cord to slide in a first direction and increase resistance to sliding of the detonation cord in a second opposite direction.

3. The detonation cord alignment apparatus as recited in claim 1, wherein the one or more protrusions are two or more protrusions that are linearly and radially staggered.

4. The detonation cord alignment apparatus as recited in claim 1, wherein the one or more protrusions are only a single protrusion.

5. The detonation cord alignment apparatus as recited in claim 1, further including a detonation cord retention insert located within the detonation cord opening, the detonation cord retention insert including the one or more protrusions for linearly securing the detonation cord.

6. The detonation cord alignment apparatus as recited in claim 5, wherein the detonation cord retention insert comprises metal or plastic.

7. A perforating gun assembly for use in a wellbore, the perforating gun assembly comprising:

a first carrier gun body;

a second carrier gun body;

a detonation cord alignment apparatus coupled between the first carrier gun body and the second carrier gun body, the detonation cord alignment apparatus including;

a gun connector housing having a detonation cord opening extending entirely there through, the gun connector housing having a first threaded connection at a first end thereof and a second threaded connection at a second end thereof, the first threaded connection engaged with the first carrier gun body and the second threaded connection engaged with the second carrier gun body; and one or more protrusions extending inward from the detonation cord opening;

a first plurality of shaped charges supported within the first carrier gun body and a second plurality of shaped charges supported within the second carrier gun body; and a detonation cord extending from at least one of the first plurality of shaped charges or the second plurality of shaped charges and through the gun connector housing, the one or more protrusions linearly securing the detonation cord in the detonation cord opening.

8. The perforating gun assembly as recited in claim 7, wherein the one or more protrusions are one or more angled barbs extending inward from the detonation cord opening for allowing the detonation cord to slide in a first direction and increase resistance to sliding of the detonation cord in a second opposite direction.

9. The perforating gun assembly as recited in claim 7, further including a detonation cord retention insert located within the detonation cord opening, the detonation cord retention insert including the one or more protrusions for linearly securing the detonation cord.

10. The perforating gun assembly as recited in claim 7, further including a detonator end alignment housing supported within the first carrier gun body or the second carrier gun body, the detonator end alignment housing including:

a detonation cord alignment housing having a second detonation cord opening extending there through; and a second set of one or more protrusions extending inward from the second detonation cord opening.

11. The perforating gun assembly as recited in claim 10, wherein the detonator end alignment housing is supported within the first carrier gun body, and further wherein the detonation cord alignment housing includes a detonator opening therein and a detonator located within the detonator opening.

12. The perforating gun assembly as recited in claim 10, wherein the detonator end alignment housing is supported within the second carrier gun body, the detonation cord opening and the second detonation cord opening linearly aligned with one another.

13. A well system, comprising:

a wellbore; and a perforating gun assembly positioned within the wellbore, the perforating gun assembly held in place by a conveyance and including:

a first carrier gun body;

a second carrier gun body a detonation cord alignment apparatus coupled between the first carrier gun body and the second carrier gun body, the detonation cord alignment apparatus including;

a gun connector housing having a detonation cord opening extending entirely there through, the gun connector housing having a first threaded connection at a first end thereof and a second threaded connection at a second end thereof, the first threaded connection engaged with the first carrier gun body and the second threaded connection engaged with the second carrier gun body; and one or more protrusions extending inward from the detonation cord opening;

a first plurality of shaped charges supported within the first carrier gun body and a second plurality of shaped charges supported within the second carrier gun body; and a detonation cord extending from at least one of the first plurality of shaped charges or the second plurality of shaped charges and through the gun connector housing, the one or more protrusions linearly securing the detonation cord in the detonation cord opening.

14. The well system as recited in claim 13, further including a detonator end alignment housing supported within the first carrier gun body or the second carrier gun body, the detonator end alignment housing including:

a detonation cord alignment housing having a second detonation cord opening extending there through; and a second set of one or more protrusions extending inward from the second detonation cord opening.

15. The well system as recited in claim 14, wherein the detonator end alignment housing is supported within the first carrier gun body, and further wherein the detonation cord alignment housing includes a detonator opening therein and a detonator located within the detonator opening.

16. The well system as recited in claim 14, wherein the detonator end alignment housing is supported within the second carrier gun body, the detonation cord opening and the second detonation cord opening linearly aligned with one another.

* * * * *